United States Patent [19]

Kelley

[11] Patent Number: 4,457,436

[45] Date of Patent: Jul. 3, 1984

[54] J-SHAPED WALL RAIL SYSTEM

[75] Inventor: Laurence J. Kelley, Tacoma, Wash.

[73] Assignee: Comerco, Inc., Tacoma, Wash.

[21] Appl. No.: 317,437

[22] Filed: Nov. 2, 1981

[51] Int. Cl.[3] ..... A47F 5/08

[52] U.S. Cl. ..... 211/88; 211/94; 248/225.2; 312/246

[58] Field of Search ..... 211/94, 88, 87, 126, 211/90, 60 T; 248/298, 225.2; 312/246, 245

[56] References Cited

U.S. PATENT DOCUMENTS

| | | | |
|---|---|---|---|
| 3,279,620 | 10/1966 | Nesbitt | 211/87 |
| 3,381,636 | 5/1968 | Saiberlich | 211/90 X |
| 4,008,872 | 2/1977 | Thompson | 211/88 X |
| 4,131,203 | 12/1978 | Bridges | 211/88 |
| 4,194,636 | 3/1980 | Byram et al. | 211/94 X |
| 4,209,098 | 6/1980 | Adams | 211/94 X |
| 4,300,692 | 11/1981 | Moreno | 211/94 X |

*Primary Examiner*—Ramon S. Britts
*Assistant Examiner*—Robert W. Gibson, Jr.

[57] ABSTRACT

There is disclosed a wall rail system for removeably supporting modular units in an environment where it is especially useful to be both mobile and aesthetically pleasing. The wall rail retains a color-coordinated protective insert panel which may be replaced from time to time in accordance with decorative requirements. A slot key is provided for attachment to the back of each modular unit, which rests securely on the J-shaped lower extension of the wall rail, and each modular unit also bears a standoff on its back below the slot key and wall rail to maintain a level orientation. This system provides modular unit support which resists typical accidental shocks yet allows easy removal by hand.

9 Claims, 4 Drawing Figures

J-SHAPED WALL RAIL SYSTEM

BACKGROUND OF THE INVENTION

This invention generally relates to the field of uniform modular units used for organization and storage. More specifically, it relates to a wall rail for support for modular units in a work or institutional environment where mobility is of great importance.

In providing storage units and work areas for commercial or institutional enterprises, it is desirable to have the maximum degree of uniformity and mobility, so that the same units can be moved about and interchanged as needs vary. This mobility should be achieved with a minimum degree effort, while at the same time providing storage units and work areas which are sturdy and stable. The units should also be aesthetically appealing.

The unit's uniformity not only contributes to aesthetic appeal but simplifies ordering new units from stock. Their mobility makes installation simple and inexpensive.

The present invention contemplates the use of a plurality of modular units as storage and work area units. Each unit is removeably secured to a wall by attachment to a wall rail which extends across all or part of the wall at a height which provides useful access to the units. One or more slot keys are attached to the rear surface of each unit to provide a suspension contact surface compatable with the diameter of the wall rail. Because the units can be removed easily from the walls, they can be readily transported to and from a central conditioning and storage facility. Additionally, the units can be provided in a number of colors, and can be rearranged at will to provide some variety in the visual environment and color coordination. The wall rail itself not only promotes these useful attributes of modular units, but should also enable further flexibility in the decorative environment. The wall rail should be installable in well-known conventional manner which does not require special training or instruction to maintenance personnel. The wall rail should support a plurality of modular units safely, resisting accidental shock and torque which are a normal part of use, while allowing removal of the units in a simple and rapid fashion.

DESCRIPTION OF THE PRIOR ART

U.S. Pat. No. 3,212,646 discloses a support system for detachably supporting a modular unit to a generally plane vertical surface, i.e., a wall. A longitudinal rail is formed or secured to the rear of the furniture piece. A correspondingly mating wall rail, secured to the wall of a room, is "hooked" onto by the furniture rail. In this manner, furniture is secured to various parts of a room.

U.S. Pat. No. 4,165,852 discloses another wall rail support system. The rail is formed of two components, a first portion permanently attached to a wall or other vertical plane and a second portion which matingly attaches to the first portion to enclose electrical wires and form a ledge. The back of each modular unit is provided with a plurality of diagonal slots running across the width of the back. A Z-shaped mounting key extends up into one such slot and down onto the ledge, to support the modular unit. A second key extends from a lower slot on the back of the unit to meet the wall, thus holding the unit in a level orientation.

SUMMARY OF THE INVENTION

The present system comprises a modular unit which may be readily secured to a wall by means of a wall rail and slot key. The rear surface of the modular unit is provided with one or more slot keys, each with a J-shaped hook extending therefrom. Each hook is fixedly held in a groove provided by the wall rail. At the bottom of the rear surface of the modular is a horizontally extending standoff which abuts against the vertical wall of the room and thereby keeps the entire modular in a horizontally level condition.

In conformance with the need to maintain an aesthetically pleasing appearance, the wall rail of the system accomodates an insert panel which serves both to conceal mounting hardware such as screws and to coordinate colors in a manner which is easily varied as the surrounding environment changes.

The above mentioned purposes are more readily apparent when read in conjunction with the following detailed description of the preferred embodiment of the present invention.

DETAILED DESCRIPTION OF THE DRAWINGS

Figure 1:
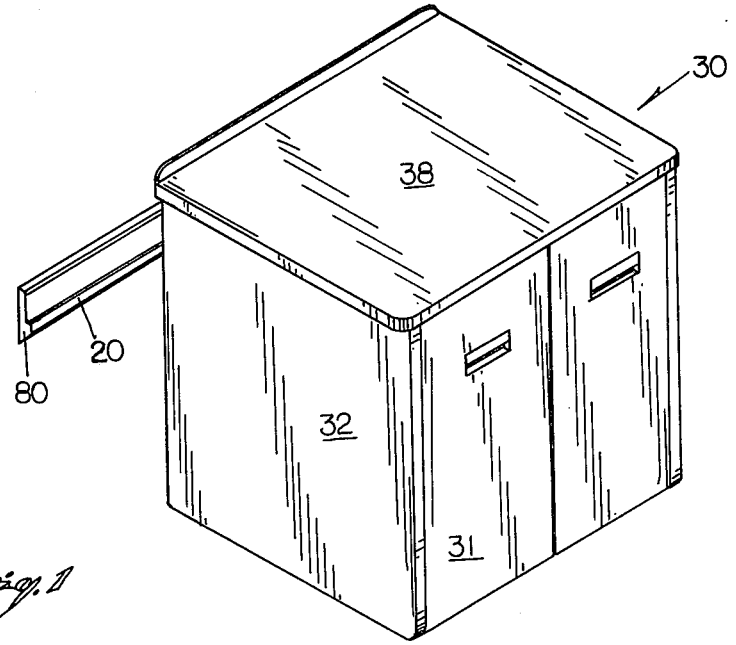
FIG. 1 is a perspective view of a modular unit mounted to a wall rail.

Referring to FIG. 1, the modular unit 30 comprises side wall 32, rear wall 36, top surface 38, bottom surface 37, and front door 31. The entire modular unit and its complimentary components are constructed of a relatively strong, heat resistent plastic material. The modular unit is constructed without any sharp corner. The absence of sharp corners on the unit provides a visually pleasing effect as well as an added safety feature.

Figure 2:
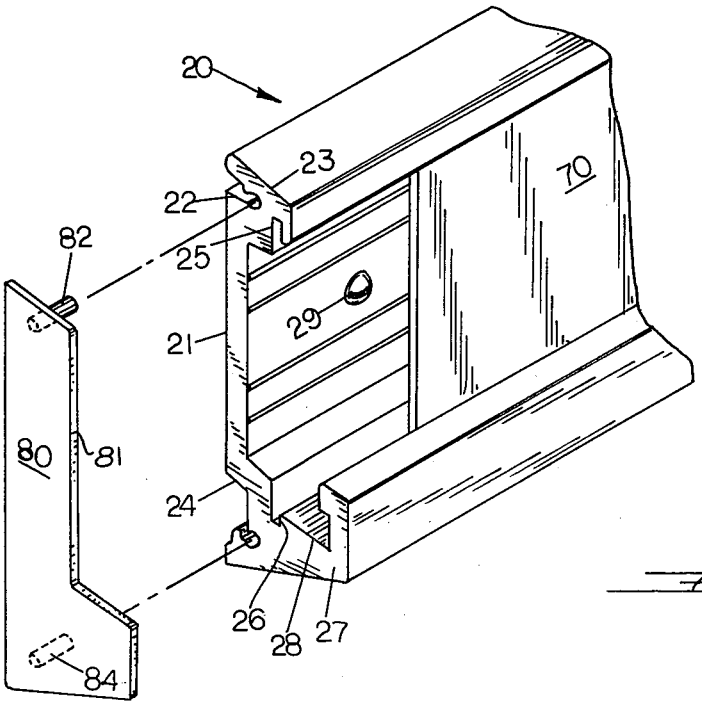
FIG. 2 is an isolated perspective view of a portion of the wall rail of FIG. 1.

Turning to FIG. 2, a slotted wall rail 20 is illustrated which, when attached to a wall, allows easy placement and replacement of modular units 30 thereon. The rail 20 comprises a vertical back 21 with upper extension 23 and lower extension 27 extending outwardly from the upper and lower edges thereof. Upper extension 23 defines upward channel 22 opening onto vertical back 21 and upper slot 25 facing lower extension 27. Lower extension 27 defines lower channel 24 facing vertical back 21 and lower slot 26 coplanar with and facing upper slot 25. Additionally, lower extension 21 defines J-shaped key channel 28.

The wall rail 20 may be affixed to a wall by a plurality of screws 29 or similar mounting hardware placed through holes in vertical backs 21 preferrably drilled by the user so as to conform to the requirements of the particular wall. After the rail 20 has been so placed, insert panel 70 may be inserted in slots 25 and 26 beginning at the ends of rail 20. Insert panel 70 serves to conceal screws 29 and additionally contributes to the color coordination of the environment. Since the panel 70 is readily removable, this element of the decor scheme can readily and inexpensively be adjusted to complement other changing characteristics of the room.

Panel 70 and vertical back 21 define a compartment 72 therebetween which may be also be advantageously used to conceal and isolate signal wires and other conduits which require alteration or removal frequently.

An end piece 80 may also be added to each and of the rail 20. The end piece 80 is advantageously made of inexpensive plastic and its shape generally corresponds to the cross-sectional configuration of rail 20. Extending from one side of planar piece 81 of end piece 80 are channel pegs 82 and 84 which are spaced apart and adapted for insertion into channels 22 and 24, respectively, or slots 25 and 26, respectively. Each end piece 80 provides an aesthetically pleasing color coordinated insertion for rail 20 which may be cut to fit the horizontal dimensions of a particular wall segment, and also serves to cover cut edges of the rail 20 which may be sharp. Each end piece 80 may be removed and replaced by hand to allow quick replacement of insert panels 70 or extension of rail 20 by placement of additional segments adjacent to an end thereof, as well as inspection of channels 22 and 24.

Figure 3:
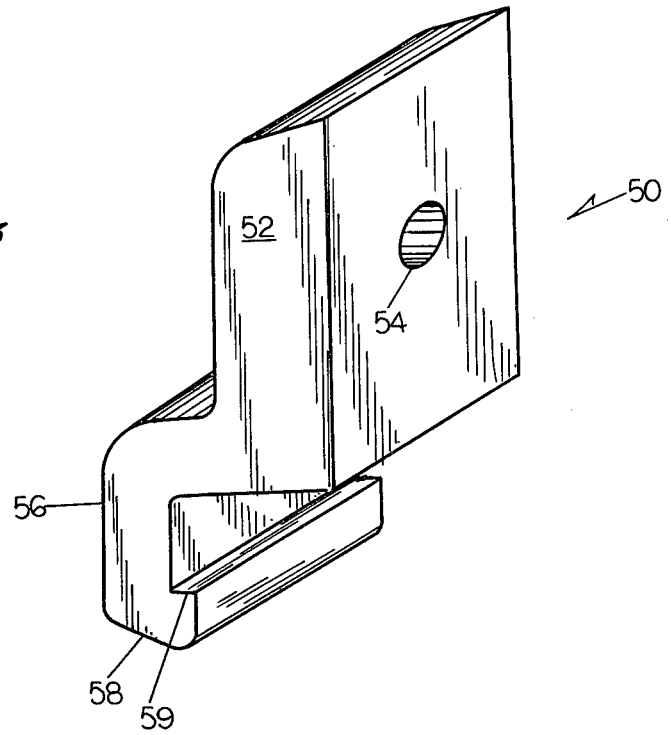
FIG. 3 is an isolated perspective view of a slot key adapted to rest on the wall rail of FIG. 2.

FIG. 3 illustrates a slot key 50 which may be attached to modular units 30 to permit suspension thereof from a rail 20. The slot key 50 includes a vertical portion 52 and a J-shaped coupler portion 56 extending at a right angle from portion 52. A bore 54 is defined through the portion 52 for attachment of the slot key 50 to modular units 30 by means of screws or other well-known mounting hardware. Only one such slot keys 50 is required to be attached to any modular unit 30 in order to achieve a stable connection between the unit 30 and a rail 20, although more than one may be preferred in situations where high load or stress conditions are expected.

Figure 4:
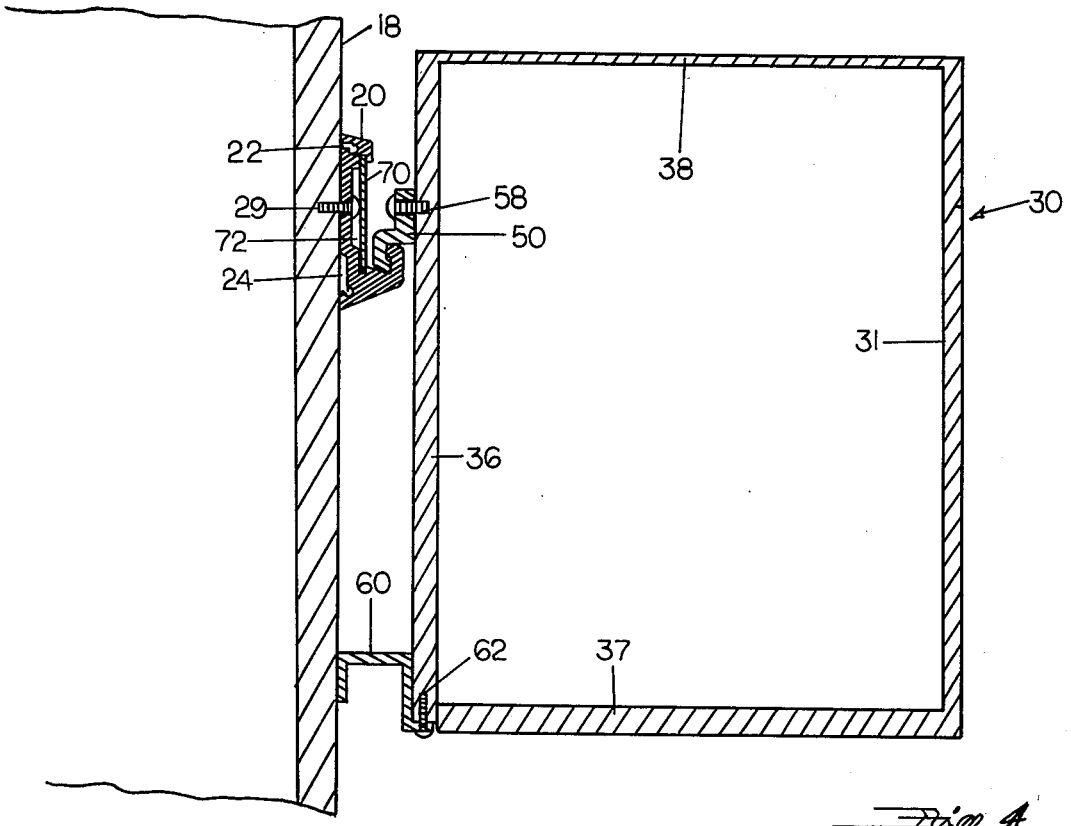
FIG. 4 is a cutaway side view of the wall rail and modular unit of FIG. 1, showing the manner of modular unit support.

FIG. 4 shows the manner in which a modular unit 30 with slot keys 50 attached thereto may be mounted to a rail 20 affixed to a wall 18. A standoff 60 is attached to modular unit 30 on the back of 36 thereof at any point below the slot keys 50. In this embodiment, the standoff 60 is generally J-shaped and is attached to back 36 via screws 62. However, any other well-known manner of providing a standoff of equal horizontal width would serve equally well to maintain the modular unit 30 in an upright posture.

Each slot key 50 is placed on the lower extension 27 of rail 20 so that coupler portion 56 of key 50 meets and engages key channel 28 of lower extension 27. It can thus be seen that a simple upward motion of unit 30 will force the ends of channel 28 and coupler portion 56 to contact one another, preventing removal of key 50 from rail 20, and the presence of standoff 60 prevents rotation of bottom-heavy unit 30 which would otherwise disengage slot key 50 from rail 20. However, the modular unit 30 is easily removed from rail 20 without the necessity of sliding the unit 30 past the end of rail 20. Removal can be accomplished by pushing the unit 30 back and up against the rail 20, so that slot key 50 meets insert panel 70. At this point, coupler portion 56 of slot key 50 has disengaged the channel 28 of rail 20, and the unit 30 may be lifted up and forward to complete the removal. To replace the unit 30 on the rail 20, the reverse of the procedure outlined above is employed.

Thus, it can be seen that the present invention provides a variety of advantages. The chamber 71 defines between vertical back 21 and insert panel 70 allows isolation of temporary wires and conduits which may be desired to be removed or replaced as needs change. Additionally, as previously mentioned, the decorative aspects of the insert panel contribute positively to the user's morale. Likewise, the end pieces 80 serve both in a decorative manner and to seal the two channels and chamber, as well as to prevent injury by contact with cut edges of the wall railing. The railing itself provides an inexpensive, convenient and sturdy means of supporting modular units while allowing the units to be redistributed with minimal effort and expertise whenever the demands of utility or decor so require.

While the preferred embodiment of the invention has been disclosed, it is to be understood that the invention is not limited thereto, since it may be otherwise embodied within the scope and spirit of the appended claims.

What is claimed:

1. A wall rail for providing support to a modular unit which is removeably secured thereto, said wall rail comprising a vertical back fixedly fastened to a wall, said vertical back having an upper horizontal extension extending from the upper edge of said vertical back and a lower horizontal extension extending from the lower edge of said vertical back, each said extensions extending outward from said wall; said upper horizontal extension defining an upper channel opening onto said wall and an upper slot opening towards said lower horizontal extension; said lower horizontal extension defining a lower channel opening onto said wall, a lower slot coplanar with and opening toward said upper slot, and a J-shaped key channel, said key channel opening towards said vertical back adjacent said lower slot; the hook and longer leg of said key channel providing contact surfaces for support of said modular unit.

2. The apparatus as claimed in claim 1 including an insert panel adapted to be removeably held within said upper and lower slots parallel to and spaced apart from said vertical back, said vertical back and said insert panel thereby defining a compartment therebetween.

3. The apparatus as claimed in claim 1 including an end panel comprising planar means and first and second peg means extending perpendicularly from one side of said planar means, said first and second peg means being spaced apart and adapted to be inserted into said upper and lower channels, respectively.

4. A suspension system for providing support to a modular unit which is removeably secured thereto, said suspension system comprising a wall rail and a plurality of slot keys; said wall rail comprising a vertical back fixedly attached to a wall in a horizontal orientation, said vertical back having an upper horizontal extension extending from the upper edge of said vertical back away from said wall, and a lower horizontal extension extending from the lower edge of said vertical back away from said wall; said upper horizontal extension defining an upper slot opening towards said lower horizontal extension and an upper channel opening onto said wall, said lower horizontal extension defining a lower slot coplanar with and opening towards said upper slot, and a J-shaped key channel, said key channel opening towards said vertical back adjacent to said lower slot; said key channel providing contact surfaces for each said slot key; each said slot key comprising a vertical portion and a J-shaped coupler portion, said vertical portion being joined to said coupler portion at right angles; said vertical portion being adapted for attachment of said slot key to said modular unit, said coupler portion being adapted to contact and rest upon said key channel of said wall rail, thereby supporting said modular unit.

5. The apparatus as claimed in claim 4 wherein said lower horizontal extension defines a lower channel opening onto said wall.

6. The apparatus as claimed in claim 4 including an insert panel adapted to extend between and be removeably held within said upper and lower slots parallel and spaced apart from said vertical back, said vertical back and said insert panel thereby defining a compartment therebetween, said compartment being adapted to contain and isolate temporary conduits.

7. The apparatus as claimed in claim 6 wherein said vertical back is fixedly fastened to said wall by a plurality of mounting screws extending through said vertical back into said wall, said mounting screws being hidden from view by said insert panel.

8. The apparatus as claimed in claim 4 including end panel means comprising planar means and first and second peg means extending perpendicularly from one side of said planar means, said first and second peg means being spaced apart and adapted to be removeably placed in said upper and lower slots, respectively, thereby holding said end panel to the end of said wall rail and covering the cut edges thereof.

9. The apparatus as claimed in claim 8 wherein said planar means is shaped to conform to the cross section of said wall rail.

* * * * *